United States Patent [19]

Penven

[11] Patent Number: 4,991,630

[45] Date of Patent: Feb. 12, 1991

[54] SINGLE LAYER PIN SEAM FABRIC HAVING PERPENDICULAR SEAMING LOOPS AND METHOD

[75] Inventor: Patrick H. Penven, Clinton, S.C.

[73] Assignee: Asten Group, Inc., Charleston, S.C.

[21] Appl. No.: 334,347

[22] Filed: Apr. 10, 1989

[51] Int. Cl.[5] ..... D03D 3/04

[52] U.S. Cl. ..... 139/383 A; 428/121; 428/124; 428/222; 428/223; 428/224

[58] Field of Search ..... 428/121, 124, 222, 223, 428/224; 139/383 AA

[56] References Cited

U.S. PATENT DOCUMENTS

| | | | |
|---|---|---|---|
| 2,883,734 | 4/1959 | Draper | 139/383 A |
| 2,907,093 | 10/1959 | Draper, Jr. | 28/72 |
| 3,060,547 | 10/1962 | MacBeam | 139/383 A |
| 3,283,388 | 11/1966 | Kelleher et al. | 28/72 |
| 3,309,790 | 3/1967 | MacBean | 34/243 |
| 3,436,041 | 4/1969 | Haller | 139/383 A |
| 3,815,645 | 6/1974 | Codorniu | 139/383 A |
| 4,026,331 | 5/1977 | Laes et al. | 139/383 A |
| 4,123,022 | 10/1978 | Dutt et al. | 245/10 |
| 4,141,388 | 2/1979 | Romanski et al. | 139/383 A |
| 4,186,780 | 2/1980 | Josef et al. | 139/383 A |
| 4,364,421 | 12/1982 | Martin | 139/383 A |
| 4,401,137 | 8/1983 | Cannon | 139/383 A |
| 4,438,788 | 3/1984 | Harwood | 138/383 A |
| 4,500,590 | 2/1985 | Smith | 428/222 |
| 4,658,863 | 4/1987 | Errecart | 139/383 A |
| 4,683,624 | 8/1987 | Dufour | 28/141 |
| 4,883,096 | 11/1989 | Penven | 139/383 A |

FOREIGN PATENT DOCUMENTS

| | | | |
|---|---|---|---|
| 982682 | 2/1965 | United Kingdom . | |
| 2178766 | 2/1987 | United Kingdom | 139/383 A |

*Primary Examiner*—James J. Bell

*Attorney, Agent, or Firm*—Volpe and Koenig

[57] ABSTRACT

A papermakers fabric is made with a woven base fabric having two ends. The base fabric includes a single layer of machine direction yarns having a system of cross machine direction yarns interwoven in a repeat pattern. At each end of the base fabric, the machine direction yarns are formed into a series of loops with an angular orientation so that the base fabric ends can be joined by intermeshing the respective end series of loops and inserting a pintle through the intermeshed loops. The angular orientation of the loops on one end of the base fabric are formed in the opposite direction from the angular orientation of the loops of the other end of the fabric when said respective end loops are intermeshed. The base fabric is heat set with the base fabric ends joined with a pintle such that both series of end loops take on a substantially vertical orientation.

16 Claims, 1 Drawing Sheet

FIG. 1
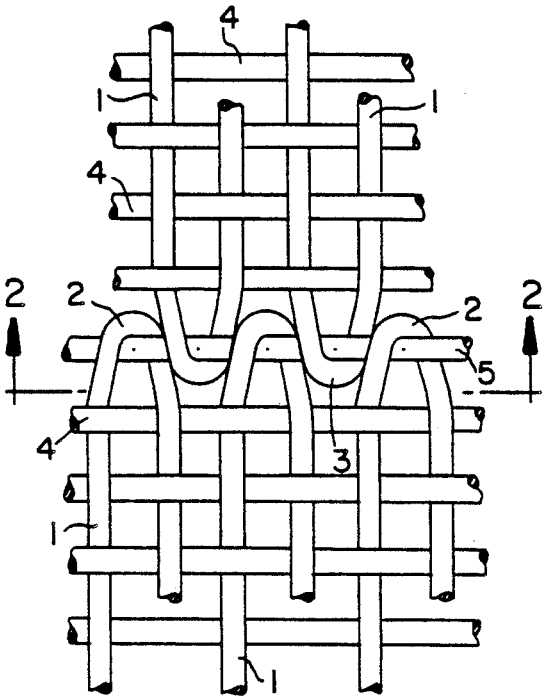
FIG. 2
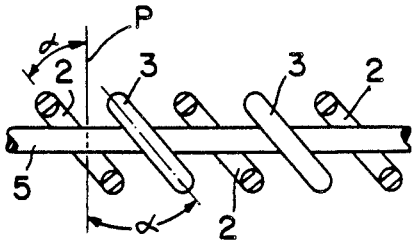
FIG. 3
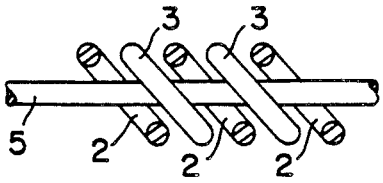
FIG. 4
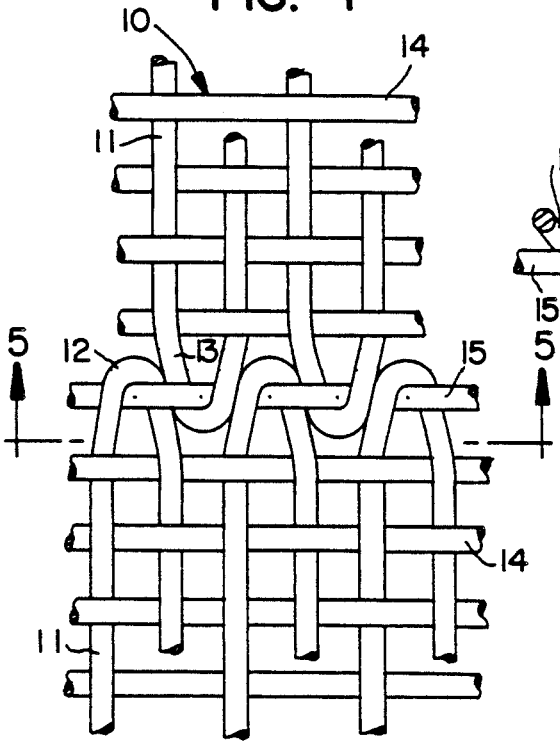
FIG. 5
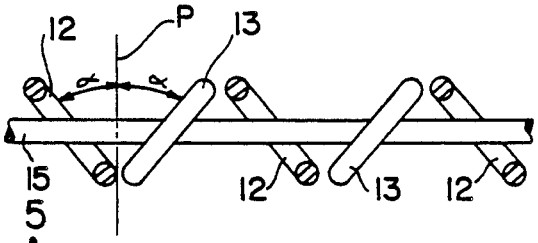
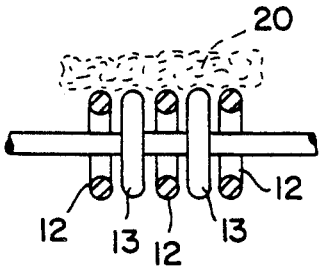
FIG. 6

SINGLE LAYER PIN SEAM FABRIC HAVING PERPENDICULAR SEAMING LOOPS AND METHOD

This application claims priority under 35 U.S.C. §120 from my copending U.S. patent applications Ser. No. 190,136 filed May 4, 1988 and Ser No. 190,037 filed May 4, 1988.

FIELD OF THE INVENTION

This invention relates generally to a joint construction for a papermakers fabric. More particularly, the invention relates to pintle seamed joints for papermakers wet press felts.

BACKGROUND OF THE INVENTION

In conventional papermaking machines, wet felts convey the sheet of paper, paperboard, etc., from the wire or cylindrical mold through various water removing equipment.

Such wet felts are often woven endless and are applied as such to the rolls of the papermaking machine. The installation of endless wet felts in the past has required cessation of operations for extended periods of time with the resultant loss of production from the paper machine.

Recent developments have resulted in greater use of seamed press felts which are joined or seamed by a pintle to simulate the endless condition. This construction is generally described as a pintle seamed joint. The inability to produce a pintle seamed joint geometry which does not differ substantially from the plane of the fabric body has been a major fault with this newer construction.

U.S. Pat. No. 2,883,734 provided a wet felt of a woven open-ended strip construction which was made endless by joining together the extensions of yarn from the weave of the felt at the joining ends thereof. One end of the wet felt is fed through the press section of the machine, until it completes a full loop. The yarn extensions at the joining ends of the felt are continuous with the weave system thereof and are used for joining together the two ends of the felt, and a textile yarn or cord is used to secure both sets of yarn extensions together and retain the two ends of the felt connected together to form an endless belt structure. Thus, the wet felt is installed without having to disassemble the machine.

The art is replete with descriptions of seam constructions for papermakers felts; see for example the disclosures of U.S. Pat. Nos. 2,883,734; 3,283,388; 3,309,790; 4,123,022; 4,141,388; 4,186,780 and 4,364,421. In general, the seam constructions of the prior art have not been entirely satisfactory for all purposes and applications.

U.S. Pat. No. 4,500,590 issued Feb. 19, 1985 to Smith, attempts to solve this problem via a composite pintle including a polyester core and an outer low-melt polymeric sheath which has been softened and deformed. This composite pintle exhibits a profile which occupies void areas in the mesh of the helical fabric in the area of the pintle joint.

The caliper of the seam area is one problem addressed by my copending patent applications Ser. No. 190,136 and Ser. No. 190,037. The permeability of the seam area and assembly of the seam during installation of the papermakers fabric can also be problematic. In particular, in single layer base fabrics having the machine direction yarns formed into series of loops for pin seaming, the machine direction yarn loops generally have an angular orientation which is not orthogonal to the pintle. The angular orientation of the loops makes the fabric more difficult to seam during installation and may adversely effect the permeability of the fabric at the seam area.

SUMMARY AND OBJECT OF THE INVENTION

A papermakers fabric is made with a woven base fabric having two ends. The base fabric includes a single layer of machine direction yarns having a system of cross machine direction yarns interwoven in a repeat pattern. At each end of the base fabric, the machine direction yarns are formed into a series of loops with a common angular orientation across the end of the base fabric. The base fabric ends can thereby be joined by intermeshing the respective end series of loops and inserting a pintle through the intermeshed loops.

Unlike conventional pin seam fabrics, the angular orientation of the loops on one end of the base fabric are formed in the opposite direction from the angular orientation of the loops of the other end of the fabric when said respective end loops are intermeshed. The base fabric is heat set with the base fabric ends joined with a pintle such that both series of end loops take on a substantially vertical orientation.

It is an object of the invention to provide a papermakers fabric and method of making same having an improved pin seam which facilitates speedy installation of the papermakers fabric. In particular it is an object to provide a base fabric for a papermakers felt having a single layer of machine direction yarns formed into end loops for pin seaming which are substantially orthogonal to the pintle.

DESCRIPTION OF THE DRAWINGS

FIG. 1 is a top plan view of a prior art single layer fabric construction;

FIG. 2 is a section taken through the line 2—2 of the single layer fabric shown FIG. 1;

FIG. 3 is the section shown in FIG. 2 after the fabric has been heat set;

FIG. 4 is a plan view of the base fabric seam area of a papermakers fabric according to the instant invention;

FIG. 5 is a section view taken along the line 5—5 of the papermakers fabric shown in FIG. 4; and FIG. 6 is the section shown in FIG. 5 after the fabric has been heat set.

DESCRIPTION OF THE PREFERRED EMBODIMENT

The terms machine direction and cross machine direction as used herein refer to the fabric orientation on the papermaking machine rather than in the loom.

FIG. 1 is a portion of a prior art seam construction in a woven fabric which includes a plurality of machine direction yarns 1 interwoven with a plurality of cross machine direction yarns 4. In order to seam the fabric, a plurality of integral contiguous seaming loops 2, 3 are formed at each terminal end, respectively, of the woven fabric. The seaming loops 2 are formed using techniques known in the art. To place the fabric in service, loops from each end of the fabric are intermeshed to form a channel and a pintle, such as 5, is inserted to retain the fabric ends together in a substantially continuous, endless structure.

With reference to FIGS. 2 and 3, the prior art construction will be explained in more detail. Generally the end loops 2, 3 in the single layer fabric are formed with an angular orientation represented by angle $\alpha$ with respect to a vertical plane P which is orthogonal to the cross machine direction pintle yarn 5. The angular orientation of the formation of loops 2, 3 is inherent in single layer fabrics since in forming the loop machine direction yarn one passes out from the end of the fabric and returns next to itself to continue the weave of the fabric. In contrast, in a base fabric having multiple layers of machine direction yarns, the machine direction yarns may extend from the end of the fabric, form the loop, and be rewoven directly beneath itself thereby forming a vertically oriented loop with no angular orientation.

Conventionally, as shown in FIGS. 1, 2, and 3, the loops of a single layer base fabrics are formed at the respective ends of the fabric such that when the loop series are intermeshed the angular orientation of respective loops 2 and 3 is generally in the same direction.

Conventionally, after the loops 2, 3 are formed, the base fabric is heat set to render stability to the base fabric and seam. Heat setting is performed with the base fabric ends joined by a pintle 5 inserted through the intermesh series of loops 2, 3 respectively. FIG. 2 illustrates the loops prior to heat setting; FIG. 3 illustrates the loops after the heat setting operation. The pintle is then removed to provide an open fabric for installation on papermaking equipment.

In such seam construction, heat setting is generally insufficient to remove the angular orientation of the seam loops. This can cause difficulty in rejoining the fabric ends when the papermakers fabric is installed on papermaking equipment and lengthen installation time.

With reference to FIG. 4 there is shown a portion of the seam area of a single layer base fabric 10 made in accordance with teachings of the present invention. The base fabric 10 includes machine direction the yarns 11 interwoven with a single layer of cross machine direction yarns 14. Similar to conventional single layer base fabrics, the machine direction yarns form a series of loops 12 and 13, respectively, at each end of the base fabric. The loops may be formed during weaving using endless and/or double endless weaving as discussed in my copending U.S. patent application Ser. No. 190,037 or, if the fabric is woven flat, the loops may be formed by back weaving the machine direction yarns as also discussed in that patent application.

As with the conventional formation of loops from machine direction yarns in a single layer base fabric, the loops 12 and 13 are formed with an angular orientation o with respect a plane P which is orthogonal to the pintle 15.

As best seen in FIG. 5, unlike conventional fabrics, the loops 12 have an angular orientation in the opposite direction as the loops 13 of the other end of the fabric. The base fabric 10 is heat set with the respective ends joined with a temporary pintle 15. The heat setting of base fabric 10 causes the angular orientation of respective loops 12 and 13 to converge towards each other and the orthogonal plane P. As best shown in FIG. 6, this results in the loops 12, 13 having a substantially vertical orientation after heat setting.

A fiberous batt 20 (shown in phantom) may be needled on one or both sides of the base fabric after heat setting dependant upon the intended usage of the finished papermakers fabric.

The temporary pintle 15 used during heat setting is removed to provide an open fabric in order to install the papermakers fabric on papermaking equipment. The substantially vertical orientation of the respective loops 12, 13 facilitates the rejoining of the fabric ends when the fabric is installed.

It will be appreciated to one ordinarily skilled in the art, that if the base fabric is woven endless, the loops 12, 13 Will be formed around a pintle yarn 15 during the weaving process. Accordingly, when the loops are formed in this manner the base fabric may be heat set in its endless state without having to intermesh the loops of the respective ends to insert a pintle therethrough. Normally the respective loops are formed around a temporary pintle. However, if the loops having the opposing angular orientations must be intermeshed and joined with pintle in the fabric's non-heat set state, any difficulty in the seaming of the non-heat set fabric is outweighed by the benefits of the substantial vertical orientation of the loops which they take on as a result of the heat setting process. The substantial vertical orientation of the end loops 12, 13 after heat setting permits the speedy seaming of the fabric ends together when the fabric is installed on papermaking equipment where paper production cannot be continued until fabric installation is completed.

The vertical orientation of the end loops 12, 13 also Contributes to a more uniform permeability of the fabric at the seam area. In addition to being easily installed, the seam of a fabric must not create an irregularity in the overall fabric which would cause the aqueous paper web which is transported by the fabric to become marked or otherwise disfigured.

What I claim is:

1. A papermakers fabric comprising:

(a) a woven base fabric having first and second ends;

(b) said base fabric including a single layer of machine direction yarns having a system of cross machine direction yarns interwoven with said machine direction yarns in a repeat pattern;

(c) at each end of said base fabric, said machine direction yarns formed with a common angular orientation into a series of loops across said respective base fabric end such that (i) said base fabric ends can be joined by intermeshing said first end series of loops with said second end series of loops and inserting a joining pintle through the intermeshed loops; and, (ii) when intermeshed, the angular orientation of the loops of said first end series being formed in the opposite direction of the angular orientation of the loops of said second end series; and (d) the angular orientation of the loops of said first and second end series having been converged toward each other and a plane orthogonal to a joining pintle by heat setting the base fabric ends while joined with a pintle.

2. A papermakers fabric according to claim 1 wherein both series of end loops have a substantially vertical orientation after heat setting the base fabric.

3. A papermakers fabric according to claim 1 further comprising a batt needled to said base fabric.

4. A papermakers fabric according to claim 3 further comprising a pintle inserted through both series of intermeshed loops thereby maintaining the ends of the base fabric joined together.

5. A papermakers fabric according to claim 1 wherein said loops are formed by back weaving the machine direction yarns.

6. A papermakers fabric according to claim 1 wherein said loops are formed during the weaving of said base fabric.

7. A papermakers fabric comprising:

(a) a woven base fabric having first and second ends;

(b) said base fabric including a single layer of machine direction yarns having a system of cross machine direction yarns interwoven with said machine direction yarns in a repeat pattern;

(c) at each end of said base fabric, said machine direction yarns formed with a common angular orientation into a series of loops across said respective base fabric end such that (i) said base fabric ends can be joined by intermeshing said first end series of loops with said second end series of loops and inserting a joining pintle through the intermeshed loops; and (ii) when intermeshed, the angular orientation of the loops of said first end series being formed in the opposite direction of the angular orientation of the loops of said second end series; and (d) said base fabric having been heat set with the base fabric ends joined with a pintle such that the loops of said first and second end series are substantially orthogonal to the cross machine direction of the base fabric.

8. A papermakers fabric according to claim 7 wherein said loops are formed by back weaving the machine direction yarns.

9. A papermakers fabric according to claim 7 wherein said loops are formed during the weaving of said base fabric.

10. A papermakers fabric according to claim 7 further comprising a batt needled to said base fabric.

11. A papermakers fabric according to claim 7 further comprising a pintle inserted through both series of intermeshed loops thereby maintaining the ends of the base fabric joined together.

12. A method of making a papermakers fabric comprising:

(a) weaving a base fabric having first and second ends, including weaving a single layer of machine direction yarns with a system of cross machine direction yarns in a repeat pattern;

(b) at each end of said base fabric, forming said machine direction yarns into loops having a common angular orientation defining a series of loops across said respective base fabric end such that (i) said base fabric ends can be joined by intermeshing said first end series of loops with said second end series of loops and inserting a joining pintle through the intermeshed loops; and (ii) the angular orientation of the loops of said first end series are in the opposite direction as the angular orientation of the loops of said second end series when the respective loops are intermeshed; and (c) heat setting said base fabric while said ends are joined with a pintle such that the angular orientation of the loops of both end series converge towards a plane orthogonal to the pintle; and (d) removing the pintle to provide an open fabric.

13. A method of making a papermakers fabric according to claim 12 wherein the end loops are formed during the weaving process.

14. A method of making a papermakers fabric according to claim 12 wherein the end loops are formed by back weaving.

15. A method of making a papermakers fabric according to claim 12 further comprising needling a fiberous batt to at least one side of said base fabric.

16. The method according to claim 15 further comprising installing the papermakers fabric on a papermaking machine by intermeshing the respective series of end loops and inserting a pintle therethrough.

* * * * *

UNITED STATES PATENT AND TRADEMARK OFFICE

CERTIFICATE OF CORRECTION

PATENT NO. : 4,991,630

DATED : February 12, 1991

INVENTOR(S) : Patrick H. Penven

It is certified that error appears in the above-identified patent and that said Letters Patent is hereby corrected as shown below:

At column 3, line 51, before the word 'with' delete the letter "o" and substitute therefore --α--.

At column 4, line 7, before the word 'be' delete the word "Will" and substitute therefore --will--.

At column 4, line 27, before the word 'to' delete the word "Contributes" and substitute therefore --contributes--.

Signed and Sealed this

Twenty-fourth Day of November, 1992

*Attest:*

DOUGLAS B. COMER

*Attesting Officer*

*Acting Commissioner of Patents and Trademarks*